US011312541B2

(12) United States Patent
Kim

(10) Patent No.: US 11,312,541 B2
(45) Date of Patent: Apr. 26, 2022

(54) SEALING CLIP

(71) Applicant: Ha Yeon Kim, Seoul (KR)

(72) Inventor: Ha Yeon Kim, Seoul (KR)

( * ) Notice: Subject to any disclaimer, the term of this patent is extended or adjusted under 35 U.S.C. 154(b) by 205 days.

(21) Appl. No.: 16/637,333

(22) PCT Filed: Sep. 12, 2017

(86) PCT No.: PCT/KR2017/010013
§ 371 (c)(1),
(2) Date: Feb. 7, 2020

(87) PCT Pub. No.: WO2019/031645
PCT Pub. Date: Feb. 14, 2019

(65) Prior Publication Data

US 2021/0362908 A1 Nov. 25, 2021

(51) Int. Cl.
*B65D 33/16* (2006.01)

(52) U.S. Cl.
CPC ..... *B65D 33/1675* (2013.01)

(58) Field of Classification Search
CPC ..... B65D 33/1675; Y10T 24/15; Y10T 24/44444
See application file for complete search history.

(56) References Cited

U.S. PATENT DOCUMENTS 1,356,785 A * 10/1920 Patterson ..... D06F 55/00 24/507
3,060,637 A * 10/1962 Fumeaux ..... A01G 7/00 47/1.01 R
4,394,791 A * 7/1983 Groth ..... B65D 33/1675 24/30.5 R
5,305,500 A * 4/1994 Tucker ..... B65D 33/1675 24/30.5 P
5,855,046 A * 1/1999 Dymott ..... G03D 13/10 24/507
6,263,703 B1 * 7/2001 Kenney ..... A44C 7/004 24/507

* cited by examiner

*Primary Examiner* — Robert Sandy
(74) *Attorney, Agent, or Firm* — Li & Cai Intellectual Property (USA) Office

(57) ABSTRACT

A sealing clip comprises: a body part provided such that an inner space is formed by a pair of members mutually connected by a coupling means; a handle part formed at one end of the body part; and an elastic part provided on inner circumferential surfaces of the pair of members of the body part. The elastic part comprises: first and second elastic portions respectively provided on upper and lower parts of an inner circumferential surface of a first member of the body part; third and fourth elastic portions respectively provided on upper and lower parts of an inner circumferential surface of a second member of the body part. The first and third elastic portions provide an upper engagement structure, the second and fourth elastic portions provide a lower engagement structure, and engagement interfaces of the upper and lower engagement structures do not coincide with each other.

6 Claims, 5 Drawing Sheets

Prior Art

SEALING CLIP

CROSS-REFERENCE TO RELATED APPLICATION(S)

This application is a continuation application of Patent Cooperation Treaty (PCT) International Application Serial No. PCT/KR2017/010013 filed on Sep. 12, 2017, which claims priority to Korean Patent Application Serial No. 10-2017-0100423 filed on Aug. 8, 2017. The entire contents of PCT International Application Serial No. PCT/KR2017/010013 and Korean Patent Application Serial No. 10-2017-0100423 are hereby incorporated by reference.

FIELD OF THE INVENTION

The present invention relates to a sealing clip, and more particularly to a sealing clip that provides an elastic material having a special structure on an inner circumferential surface of the clip, thereby improving the sealing capability of a food packaging container.

BACKGROUND

In general, a sealing clip is used to seal an opened packaging container of a vinyl material so that the contents inside the packaging container are not exposed to the outside.

A packaging container of a vinyl material is intended to prevent food ingredients, snacks, or sweets from being dampened or oxidized by external moisture or air, and the sealing capability of the packaging container is maintained in a normal product distribution process. However, the contents may be dampened or oxidized if a consumer opens the packaging container to consume only a part of the contents and then the packaging container is kept open. In this regard, there are a number of means for sealing an opened mouth of such a packaging container, and a sealing clip is one of such means.

FIG. 1 shows conventional means for sealing opened packaging containers. Here, the opened mouths of the packaging containers are sealed with various means such as a rubber band, wooden chopsticks, and a clothespin.

However, such methods have been used as temporary measures to seal the opened mouths. The rubber band, wooden chopsticks, or clothespin cannot completely block the penetration of air and moisture into the packaging containers, and can only temporarily seal the packaging containers due to the low durability.

As a means for solving the above-mentioned problem, a sealing clip with a protruding sidewall being formed on an inner side as shown in FIG. 2 has been introduced.

Referring to FIG. 2, the sealing clip comprises an upper support and a lower support connected to the upper support, and locking members provided at the ends of the supports to lock or unlock the supports. A sidewall protruding in the longitudinal direction is formed on the bottom surface of the upper support, and a hole facing the sidewall formed on the bottom surface of the upper support is formed in the lower support in the longitudinal direction. The conventional means shown in FIG. 2 may seal a packaging container by locking the supports with the locking members after the packaging container is introduced between the protruding sidewall of the upper support and the side where the hole is formed in the lower support.

However, the sealing clip shown in FIG. 2 has problems that the locking members should be operated with both hands, and that the locking members can be easily broken since they are fitted to each other. Further, there is a problem that the sealing capability of the supports to seal the packaging container is low since only the protruding sidewall and the hole press the packaging container. In addition, there is a problem that when a thin packaging container is sealed, the packaging container is slipped from the sealing clip since the sealing clip cannot strongly fix the packaging container, and when a thick packaging container is sealed, the sealing clip is detached from the packaging container since it cannot deal with the thickness.

SUMMARY OF THE INVENTION

One object of the present invention is to provide a sealing clip that provides a multiple sealing structure to enhance sealing capability and sealing retention capability.

Another object of the invention is to provide a sealing clip that a user can conveniently use with one hand.

The representative configurations of the invention to achieve the above objects are described below.

A sealing clip 10 according to one embodiment of the present invention comprises: a body part 100 provided such that an inner space S is formed by a pair of members mutually connected by a coupling means C; a handle part 200 formed at one end of the body part 100; and an elastic part 300 provided on inner circumferential surfaces of the pair of members of the body part 100.

Here, the elastic part 300 comprises: a first elastic portion 310 provided on an upper part of an inner circumferential surface of a first member of the body part 100; a second elastic portion 320 provided on a lower part of the inner circumferential surface of the first member of the body part 100; a third elastic portion 330 provided on an upper part of an inner circumferential surface of a second member of the body part 100; and a fourth elastic portion 340 provided on a lower part of the inner circumferential surface of the second member of the body part 100.

Here, the first elastic portion 310 and the third elastic portion 330 provide an upper engagement structure, the second elastic portion 320 and the fourth elastic portion 340 provide a lower engagement structure, and an engagement interface of the upper engagement structure does not coincide with an engagement interface of the lower engagement structure.

Here, using the terms like the upper and lower engagement structures does not limit the scope of the invention to providing two different sealing structures at the upper and lower parts. It should be understood that the scope of the invention also encompasses the case, for example, where three elastic portions are provided on the inner circumferential surface of the first member, three elastic portions are provided on the inner circumferential surface of the second member, and engagement interfaces formed by the elastic portions of the respective members coming into contact as the first and second members are engaged do not coincide with each other (e.g., the first and second engagement interfaces from the top do not coincide with each other, and the second and third engagement interfaces do not coincide with each other).

The non-coincidence of the upper and lower engagement interfaces may be implemented in a plurality of embodiments.

First, the first elastic portion 310 and the fourth elastic portion 340 may have similarity in shape (or have a first shape) and the second elastic portion 320 and the third elastic portion 330 may have similarity in shape (or have a second shape), wherein the first and second shapes may be different from each other.

Further, the first elastic portion 310 and the fourth elastic portion 340 may have similarity in shape (or have a first shape) and the second elastic portion 320 and the third elastic portion 330 may have similarity in shape (or have a second shape), wherein the first and second shapes may be symmetrical to each other.

The non-coincidence of the engagement interfaces of the upper and lower engagement structures may provide multiple different engagement structures at the upper and lower parts.

Meanwhile, when the first and second shapes are implemented differently, the first shape may be provided as two circles including two holes h and the second shape may be provided as a single circle including a single hole h. It should be understood that, when the first and second shapes are implemented differently, the forms and number of features provided to form the different shapes can be freely selected without departing from the scope of the invention. In addition, it should also be understood that there are no limitations on the materials forming the elements of the invention.

Additional configurations for achieving the objects of the invention may also be provided.

According to the invention, it is possible to provide a sealing clip that provides a multiple sealing structure to enhance sealing capability and sealing retention capability.

Further, according to the invention, it is possible to provide a sealing clip that a user can conveniently use with one hand.

DETAILED DESCRIPTION

Figure 1:
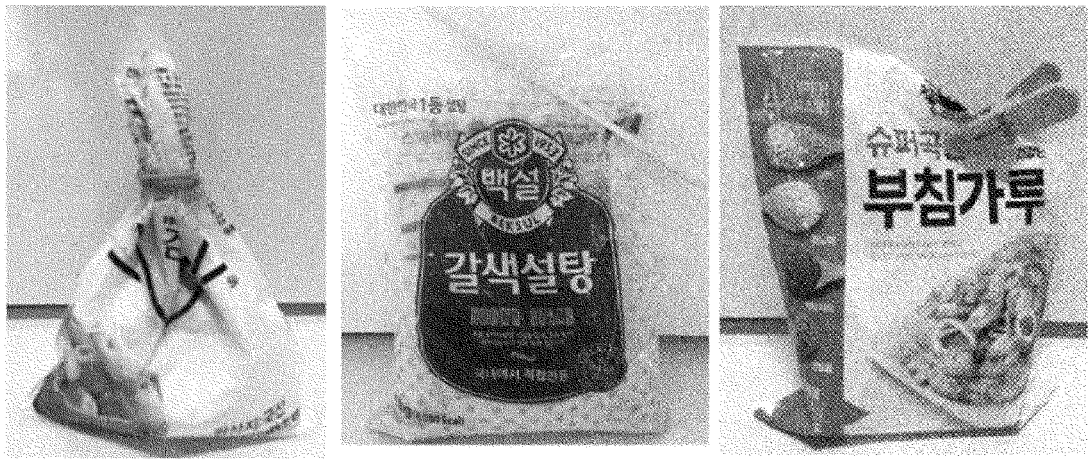
FIG. 1 shows photographs of conventional sealing means for sealing packaging containers.
Figure 2:
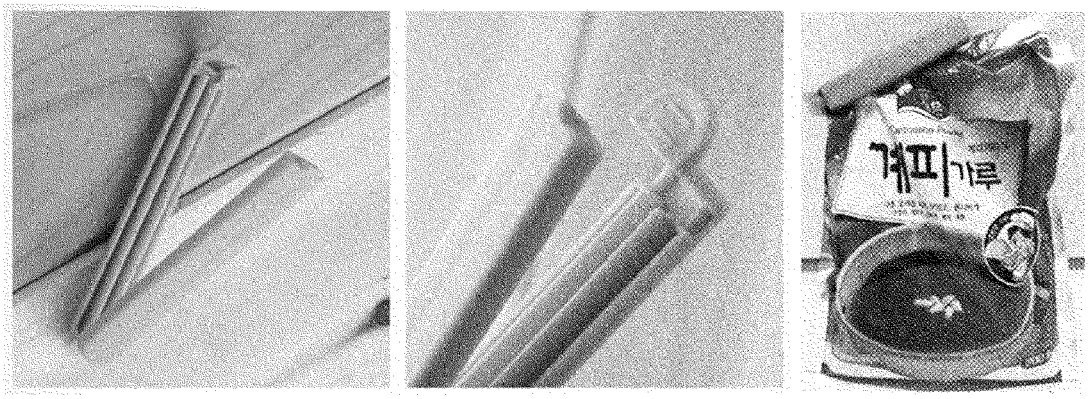
Prior Art FIG. 2
FIG. 2 shows photographs of a conventional sealing clip for sealing a packaging container.

In the following detailed description of the present invention, references are made to the accompanying drawings that show, by way of illustration, specific embodiments in which the invention may be practiced. These embodiments are described in sufficient detail to enable those skilled in the art to practice the invention. It is to be understood that the various embodiments of the invention, although different from each other, are not necessarily mutually exclusive. For example, specific shapes, structures and characteristics described herein may be implemented as modified from one embodiment to another without departing from the spirit and scope of the invention. Furthermore, it shall be understood that the locations or arrangements of individual elements within each of the embodiments may also be modified without departing from the spirit and scope of the invention. Therefore, the following detailed description is not to be taken in a limiting sense, and the scope of the invention is to be taken as encompassing the scope of the appended claims and all equivalents thereof. In the drawings, like reference numerals refer to the same or similar elements throughout the several views.

Hereinafter, various preferred embodiments of the present invention will be described in detail with reference to the accompanying drawings to enable those skilled in the art to easily implement the invention.

Preferred Embodiments of the Invention

Figure 3:
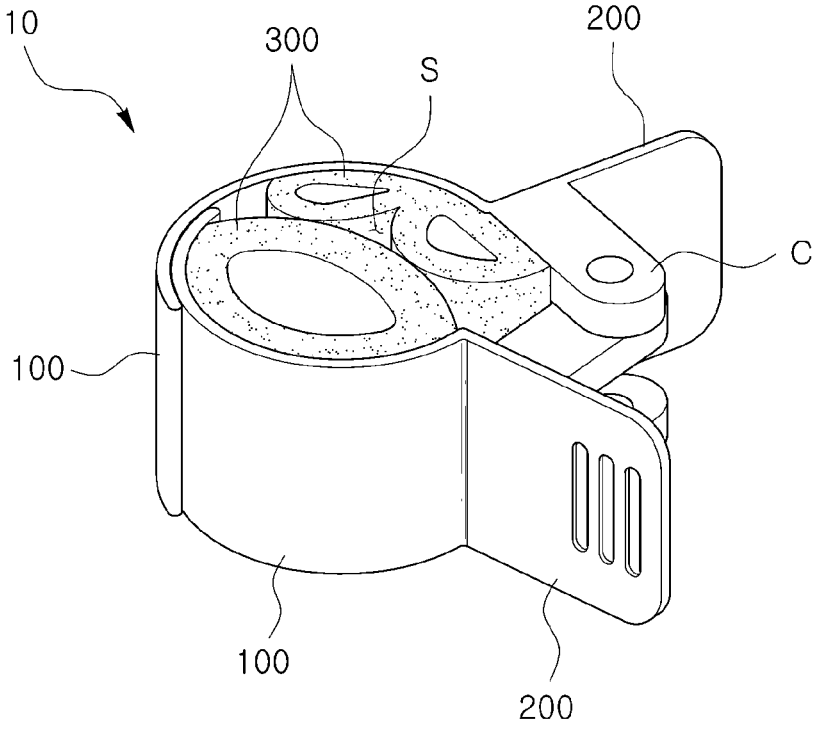
FIG. 3 shows a state in which a sealing clip according to one embodiment of the invention is closed.

FIG. 3 shows a state in which a sealing clip 10 according to one embodiment of the invention is closed. The configuration of the sealing clip 10 according to one embodiment of the invention will be described with reference to FIG. 3. A packaging container to be described below is used for containing and packaging food, and may be formed of a common vinyl material. The scope of the invention is not limited by the material of the packaging container.

The sealing clip 10 according to one embodiment of the invention may include a body part 100, a handle part 200, and an elastic part 300.

First, one end of the body part 100 according to one embodiment of the invention is connected to the handle part 200 to be described below, and an inner space S is formed by inner circumferential surfaces of the body part 100. The shape of the inner circumferential surfaces of the body part 100 may be arcuate. The body part 100 may be constituted by a pair of members facing each other, and one member of the pair of members may be configured to extend wrapping the other member. The pair of members facing each other and constituting the body part 100 may be coupled to each other by a coupling means C. The coupling means C may be formed in a foldable hinge structure but is not limited to the foldable hinge structure shown in FIG. 3. The coupling means C formed in a foldable hinge structure may include a tension applying means (e.g., a torsion spring) for applying strong pressure to the packaging container.

The handle part 200 according to one embodiment of the invention is connected to the body part 100. The handle part 200 is formed such that an operator may press the handle part 200 with an hand to open or close the body part 100. A plurality of grooves may be formed on sides of the handle part 200 so that the hand does not slip when pressing the handle part 200.

The elastic part 300 according to one embodiment of the invention is provided such that it is attached to the inner circumferential surfaces of the body part 100, and is formed of a plurality of elastic materials. Further, the elastic part 300 is provided to the body part 100 constituted by the pair of members, in a structure peculiar to the invention, so as to multilaterally apply strong pressure to an opened mouth of the packaging container. The structure of the elastic part 300 is crucial to invention and will be described in more detail below.

Figure 4:
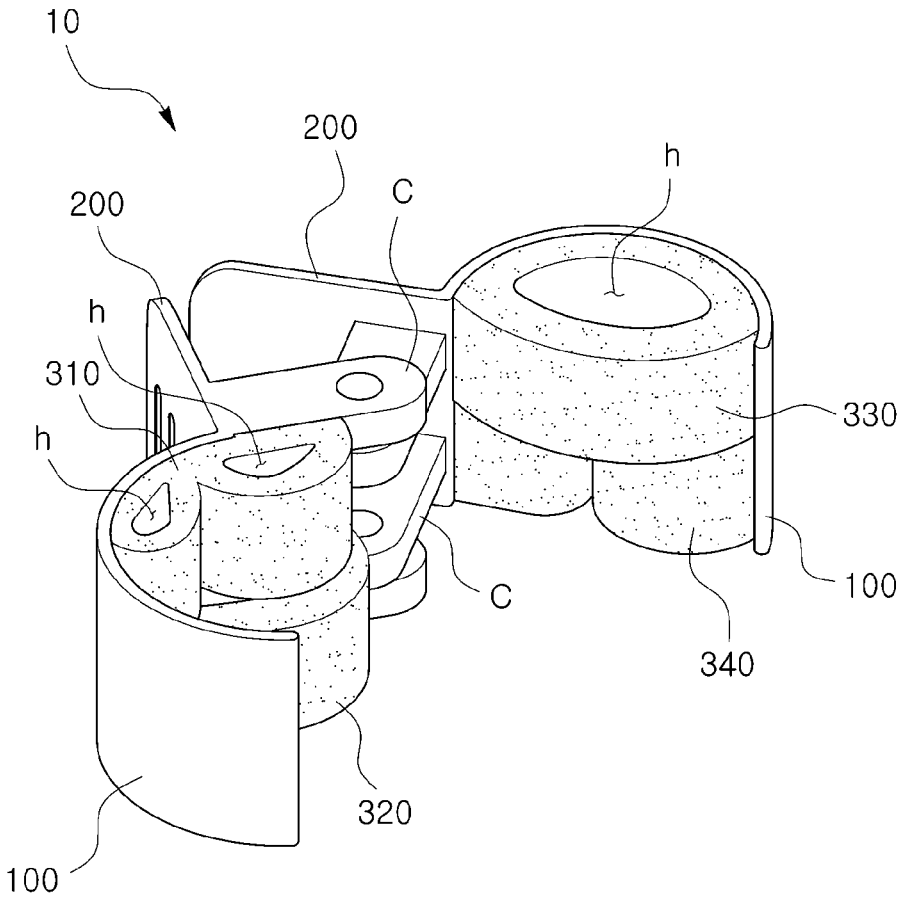
FIG. 4 shows a state in which the sealing clip according to one embodiment of the invention is opened.

Description of the Elastic Part 300 According to One Embodiment of the Invention FIG. 4 shows a state in which the sealing clip 10 according to one embodiment of the invention is opened.

Referring to FIG. 4, the elastic part 300 of the sealing clip 10 may be positioned on the inner circumferential surface of each of the pair of members of the body part 100 facing each other. Specifically, the elastic part 300 of the sealing clip 10 may be provided in a total of four different areas formed by dividing the inner circumferential surface of each of the pair of members of the body part 100 into upper and lower parts, in a manner peculiar to the invention, so as to seal an outer surface of the packaging container that is introduced into the inner space S of the sealing clip 10.

The elastic part 300 is completed by being provided in the total of four different areas as above, and may particularly include a first elastic portion 310, a second elastic portion 320, a third elastic portion 330, and a fourth elastic portion 340. The shape of each elastic portion may be a circle (which does not mean a perfect circle in a mathematical sense but encompasses a rounded shape such as an ellipse) with a hole h being formed in the center as shown in FIG. 4, for example.

The first elastic portion 310 is provided at an upper part of the inner circumferential surface of a first member of the pair of members constituting the body part 100.

The second elastic portion 320 is provided at a lower part of the inner circumferential surface of the first member of the pair of members constituting the body part 100.

The third elastic portion 330 is provided at an upper part of the inner circumferential surface of a second member of the pair of members constituting the body part 100.

The fourth elastic portion 340 is provided at a lower part of the inner circumferential surface of the second member of the pair of members constituting the body part 100.

Here, the first elastic portion 310 and the fourth elastic portion 340 have similarity in shape. As shown in FIG. 4, each of the first elastic portion 310 and the fourth elastic portion 340 may be in the shape of two circles including two holes h.

Further, the second elastic portion 320 and the third elastic portion 330 have similarity in shape. As shown in FIG. 4, each of the second elastic portion 320 and the third elastic portion 330 may be in the shape of a single circle including a single hole h. The similarity in shape referred to herein does not mean complete equality in size and shape, but means equality in the number of holes h and the number of provided circles.

When the first elastic portion 310 and the fourth elastic portion 340 having similarity in shape are referred to as having a first shape, and the second elastic portion 320 and the third elastic portion 330 having similarity in shape are referred to as having a second shape, the first and second shapes are formed differently from each other.

In the present embodiment, the first shape is implemented as two circles including two holes h, and the second shape is implemented as a single circle including a single hole h. However, as long as the first and second shapes are formed differently, the first and second shapes are not limited to the shapes implemented in the present embodiment.

When the elastic part 300 is implemented as described above, the first elastic portion 310 and the third elastic portion 330 apply pressure to an upper part of the opened mouth of the packaging container, and the second elastic portion 320 and the fourth elastic portion 340 apply pressure to a lower part of the opened mouth of the packaging container. Since the first elastic portion 310 and the fourth elastic portion 340 have similarity in shape (i.e., have the first shape) and the second elastic portion 320 and the third elastic portion 330 have similarity in shape (i.e., have the second shape different from the first shape), upper and lower engagement interfaces do not coincide with but are staggered from each other when the sealing clip is closed to perform a sealing operation. That is, when pressure is applied to the opened mouth of the packaging container, upper and lower pressure applying structures are formed to be staggered from each other. This results in a double pressure application effect as if two different pressure applying structures are provided.

This double pressure application effect may particularly advantageously achieve the effect of preventing the contents in the packaging container from being spoiled by blocking the penetration of air and moisture into the packaging container.

Although two different pressure applying structures at the upper and lower parts are illustrated by way of example in the embodiment of FIG. 4, the scope of the invention should not be limited to the two pressure applying structures. In accordance with the principle of the invention, the scope of the invention also encompasses the case where three or more different pressure applying structures are provided. This also applies to other embodiments according to the invention.

Figure 5:
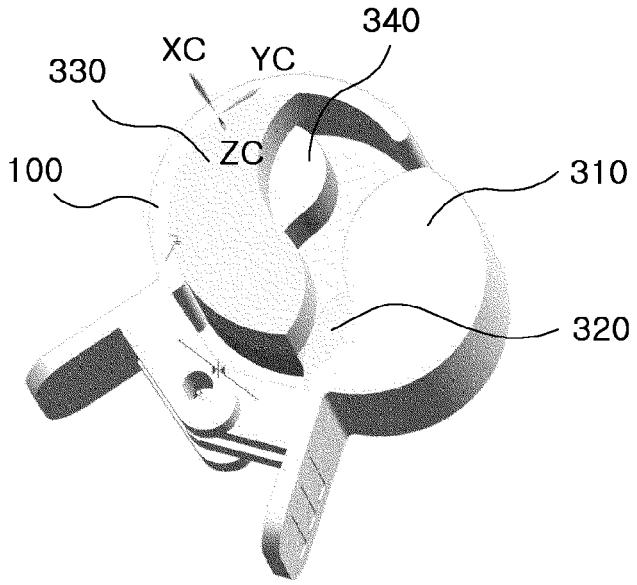
FIG. 5 shows a state in which a sealing clip according to another embodiment of the invention is opened, wherein elastic structures different from those of FIG. 4 are shown.

FIG. 5 shows a state in which a sealing clip according to another embodiment of the invention is opened, wherein elastic structures different from those of FIG. 4 are shown.

Referring to FIG. 5, it can be seen that the elastic part 300 is provided in a total of four different areas formed by dividing the inner circumferential surface of each of the pair of members of the body part 100 into upper and lower parts. In the embodiment of FIG. 5, the elastic part 300 is provided in the total of four different areas as in the embodiment of FIG. 4, and may particularly include a first elastic portion 310, a second elastic portion 320, a third elastic portion 330, and a fourth elastic portion 340.

However, the embodiment of FIG. 5 differs from the embodiment of FIG. 4 in terms of the similarity in shape between the respective elastic portions.

In the embodiment of FIG. 4, the first elastic portion 310 and the fourth elastic portion 340 have similarity in shape (i.e., have a first shape) and the second elastic portion 320 and the third elastic portion 330 have similarity in shape (i.e., have a second shape), wherein the first and second shapes are different from each other.

In the embodiment of FIG. 5, the first elastic portion 310 and the fourth elastic portion 340 have similarity in shape and the second elastic portion 320 and the third elastic portion 330 have similarity in shape as in the embodiment of FIG. 4, whereas the first and second shapes are not different from but symmetrical to each other.

In this case, it is also possible to achieve the same effects as those described in connection with the embodiment of FIG. 4. This is because an engagement interface of the first elastic portion 310 and the third elastic portion 330, which are engaged with each other at the upper part, does not coincide with an engagement interface of the second elastic portion 320 and the fourth elastic portion 340, which are engaged with each other at the lower part.

When the engagement interfaces do not coincide with but are staggered from each other as above, the upper and lower pressure applying structures are staggered from each other when pressure is applied to the opened mouth of the packaging container. This results in a double pressure application effect as if two different pressure applying structures are provided. This double pressure application effect may effectively prevent the contents in the packaging container from being spoiled by blocking the penetration of air and moisture into the packaging container, which is also equally achieved in the embodiment of FIG. 5.

Figure 6:
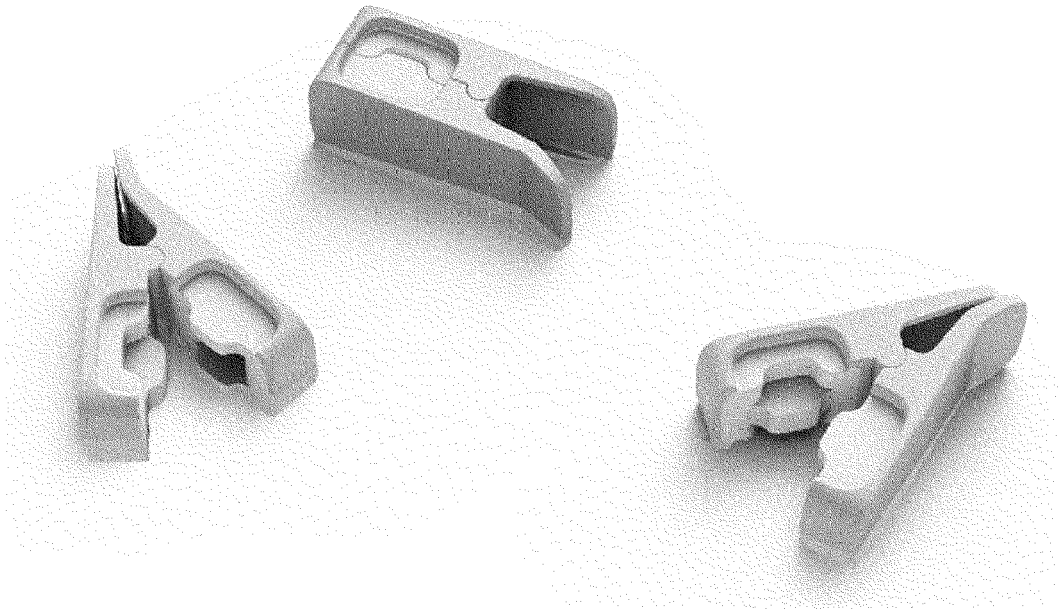
FIG. 6 shows a view of a sealing clip according to yet another embodiment of the invention, wherein elastic structures different from those of FIGS. 4 and 5 are shown.

FIG. 6 shows a view of a sealing clip according to yet another embodiment of the invention.

Likewise, in the embodiment shown in FIG. 6, an engagement interface of an upper engagement structure does not coincide with an engagement interface of a lower engagement structure when the sealing clip is closed to perform a sealing operation. As a result, the upper and lower pressure applying structures are staggered from each other when the sealing clip performs the sealing operation, so that the advantageous effects as described in connection with the embodiment of FIG. 5 are equally achieved. In addition, it should be understood that any type of sealing clip, which achieves a multiple pressure application effect by staggering upper and lower pressure applying structures such that engagement interfaces of upper and lower engagement structures do not coincide with each other, falls within the scope of the invention.

Figure 7:
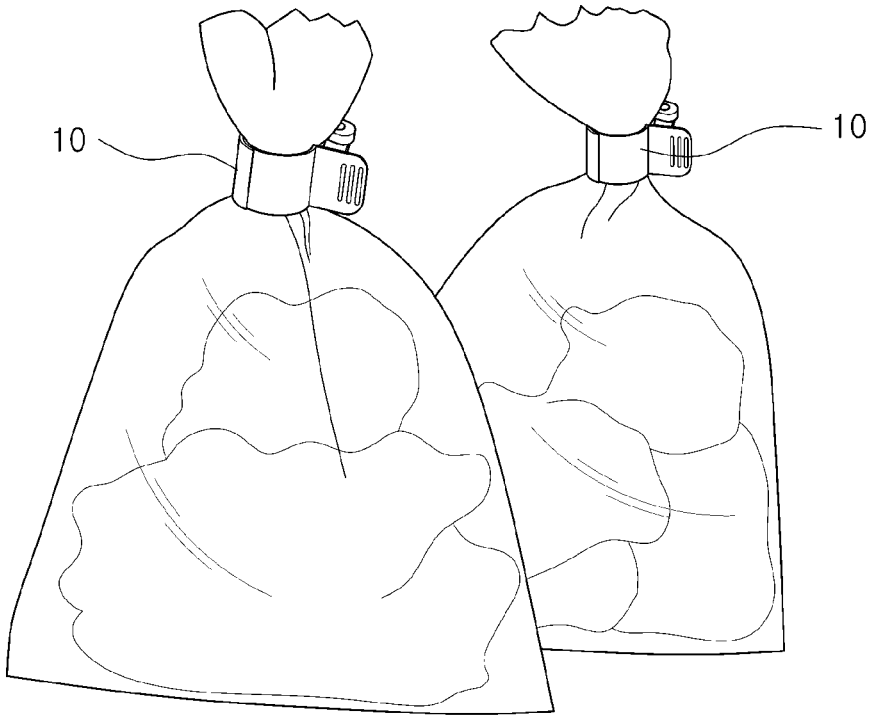
FIG. 7 shows a state in which a sealing clip according to one embodiment of the invention is applied to a packaging container.

FIG. 7 shows a state in which sealing clips according to the above-described embodiments of the invention are applied to packaging containers. It is to be understood that the sealing clips according to the invention are not limited to being applied to the packaging containers of the types shown in FIG. 7.

Although the present invention has been described above in terms of specific items such as detailed elements as well as the limited embodiments and the drawings, they are only provided to help more general understanding of the invention, and the present invention is not limited to the above embodiments. It will be appreciated by those skilled in the art to which the present invention pertains that various modifications and changes may be made from the above description.

Therefore, the spirit of the present invention shall not be limited to the above-described embodiments, and the entire scope of the appended claims and their equivalents will fall within the scope and spirit of the invention.

What is claimed is:

1. A sealing clip (10), comprising:

a body part (100) provided such that an inner space (S) is formed by a pair of members mutually connected by a coupling means (C);

a handle part (200) formed at one end of the body part (100); and an elastic part (300) provided on inner circumferential surfaces of the pair of members of the body part (100), wherein the elastic part (300) comprises:

a first elastic portion (310) provided on an upper part of an inner circumferential surface of a first member of the body part (100);

a second elastic portion (320) provided on a lower part of the inner circumferential surface of the first member of the body part (100);

a third elastic portion (330) provided on an upper part of an inner circumferential surface of a second member of the body part (100); and a fourth elastic portion (340) provided on a lower part of the inner circumferential surface of the second member of the body part (100), wherein the first elastic portion (310) and the third elastic portion (330) provide an upper engagement structure, and the second elastic portion (320) and the fourth elastic portion (340) provide a lower engagement structure, and wherein an engagement interface of the upper engagement structure does not coincide with an engagement interface of the lower engagement structure.

2. The sealing clip (10) of claim 1, wherein the first elastic portion (310) and the fourth elastic portion (340) have a first shape, the second elastic portion (320) and the third elastic portion (330) have a second shape, and the first and second shapes are different from each other.

3. The sealing clip (10) of claim 2, wherein the non-coincidence of the engagement interfaces of the upper and lower engagement structures provides multiple different engagement structures at the upper and lower parts.

4. The sealing clip (10) of claim 2, wherein the first shape is provided as two circles including two holes (h), and the second shape is provided as a single circle including a single hole (h).

5. The sealing clip (10) of claim 1, wherein the first elastic portion (310) and the fourth elastic portion (340) have a first shape, the second elastic portion (320) and the third elastic portion (330) have a second shape, and the first and second shapes are symmetrical to each other.

6. The sealing clip (10) of claim 5, wherein the non-coincidence of the engagement interfaces of the upper and lower engagement structures provides multiple different engagement structures at the upper and lower parts.

* * * * *